US010542854B2

(12) United States Patent
Harris et al.

(10) Patent No.: US 10,542,854 B2
(45) Date of Patent: Jan. 28, 2020

(54) SELF-ORIENTING WIPES DISPENSING NOZZLES AND WIPES DISPENSERS HAVING THE SAME

(71) Applicant: GOJO Industries, Inc., Akron, OH (US)

(72) Inventors: Donald R. Harris, Tallmadge, OH (US); Aaron D. Marshall, Uniontown, OH (US); Nick E. Ciavarella, Seven Hills, OH (US); Jonathan Michael Johnson, Akron, OH (US); Christopher James Mann, Hudson, OH (US); Kevin Michael Vail, North Royalton, OH (US); Jenna Ann Matus, Copley, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/964,980

(22) Filed: Apr. 27, 2018

(65) Prior Publication Data

US 2018/0310782 A1 Nov. 1, 2018

Related U.S. Application Data

(60) Provisional application No. 62/490,937, filed on Apr. 27, 2017.

(51) Int. Cl.
*A47K 10/42* (2006.01)
*A47K 10/38* (2006.01)
(Continued)

(52) U.S. Cl.
CPC ..... *A47K 10/421* (2013.01); *A47K 7/03* (2013.01); *A47K 10/3818* (2013.01);
(Continued)

(58) Field of Classification Search
None
See application file for complete search history.

(56) References Cited

U.S. PATENT DOCUMENTS 4,180,160 A 12/1979 Eshima et al.
5,141,171 A * 8/1992 Yang ..... A47K 10/3818 206/233

(Continued)

FOREIGN PATENT DOCUMENTS

EP 0534600 A2 3/1993
EP 2152133 A2 2/2010
EP 2606795 A1 6/2013

OTHER PUBLICATIONS

International Search Report and Written Opinion from PCT/US2018/029858 dated Jul. 2, 2018 (17 pages).

*Primary Examiner* — Jacob S. Scott
*Assistant Examiner* — Ayodeji T Ojofeitimi
(74) *Attorney, Agent, or Firm* — Calfee, Halter & Griswold LLP

(57) ABSTRACT

Exemplary embodiments of wipes dispensers are disclosed herein. An exemplary wipes dispenser includes a container, a plurality of wipes contained within the container, a fluid for wetting the plurality of wipes and a self-orientating outlet nozzle. The self-orientating outlet nozzle includes a moveable outlet opening. The moveable outlet opening aligns with the direction of pull of the wipe when the wipe is pulled out of the dispenser at an angle that is not substantially vertical.

20 Claims, 14 Drawing Sheets

(51) Int. Cl.
*A47K 7/03* (2006.01)
*A47K 10/32* (2006.01)

(52) U.S. Cl.
CPC ..... *A47K 2010/3206* (2013.01); *A47K 2010/3233* (2013.01); *A47K 2010/3266* (2013.01)

(56) References Cited

U.S. PATENT DOCUMENTS

| | | | | |
|---|---|---|---|---|
| 5,215,211 | A | 6/1993 | Eberle | |
| 5,560,514 | A | 10/1996 | Frazier | |
| 6,523,690 | B1 | 2/2003 | Buck et al. | |
| 6,766,919 | B2 | 7/2004 | Huang et al. | |
| 8,944,279 | B2 | 2/2015 | Shoaf et al. | |
| 9,101,250 | B2 * | 8/2015 | Ray | A47K 10/24 |
| 9,226,627 | B2 | 1/2016 | Powling et al. | |
| 9,687,125 | B2 | 6/2017 | Marietta-Tondin et al. | |
| 9,986,875 | B2 | 6/2018 | Mehdizadeh | |
| 2006/0261076 | A1 | 11/2006 | Anderson | |
| 2007/0199949 | A1 * | 8/2007 | Simkins | A47K 10/3818 221/63 |
| 2010/0176021 | A1 | 7/2010 | Gordon | |
| 2010/0206896 | A1 * | 8/2010 | Ray | A47K 10/3818 221/45 |
| 2010/0264159 | A1 | 10/2010 | Gordon | |
| 2013/0306669 | A1 | 11/2013 | Ray | |
| 2015/0048105 | A1 | 2/2015 | Gordon | |
| 2015/0114985 | A1 | 4/2015 | Mehdizadeh | |
| 2015/0122937 | A1 | 5/2015 | Marietta-Tondin | |
| 2015/0208880 | A1 | 7/2015 | Saarvali et al. | |
| 2018/0206684 | A1 | 7/2018 | Tedesco | |

* cited by examiner

SELF-ORIENTING WIPES DISPENSING NOZZLES AND WIPES DISPENSERS HAVING THE SAME

RELATED APPLICATIONS

The present invention claims priority to and the benefits of U.S. Provisional Patent Application Ser. No. 62/490,937 titled WIPES DISPENSER HAVING A SWIVEL DISPENSING NOZZLE filed on Apr. 27, 2017 and which is incorporated herein in its entirety.

TECHNICAL FIELD

The present invention generally relates to methods and systems for dispensing wipes or moist towelettes. More particularly, the present invention relates to self-orientating wipes dispensing nozzles, dispensers having self-orientating wipes dispensing nozzles and methods for dispensing wipes.

BACKGROUND OF THE INVENTION

Wipes are typically made from a variety of materials, such as non-woven materials. Wipes are often moistened with solutions, such as cleaning solutions and or antimicrobial solutions. The wipes may be stacked and folded in a container or may be in the form of a roll. Wipes in the form of a roll typically have perforations between the wipes. The strength of the material between the two wipes is critical. It needs to be strong enough sot the wipes remain attached to one another until the top of the trailing wipe is pulled up through a dispensing outlet nozzle and weak enough to break when the leading tail of the second wipe is high enough above the outlet nozzle that it may be grabbed by a user and pulled out of the container when another wipe is required. However, often the lead tail does not extend high enough past the opening for a user to grab, which leads to customer "short tail" complaints. In addition, the strength of the material between the two wipes must be weak enough so that when the leading edge of the wipe is sufficiently above the outlet nozzle, the material breaks. When it does not break, "roping" occurs and multiple wipes are pulled out of the nozzle, when only one was required. Attempting to pull a wipe from the dispenser at an angle that is not substantially straight (and generally substantially straight upward) out of the nozzle causes additional forces on the wipe and often lead to short tail issues.

SUMMARY

Exemplary embodiments of wipes dispensers are disclosed herein. An exemplary wipes dispenser includes a container, a plurality of wipes contained within the container, a fluid for wetting the plurality of wipes and a self-orientating outlet nozzle. The self-orientating outlet nozzle includes a moveable outlet opening. The moveable outlet opening aligns with the direction of pull of the wipe when the wipe is pulled out of the dispenser at an angle that is not substantially vertical.

Another exemplary embodiment of a wipes dispenser includes a container for holding a plurality of wipes and a self-orientating outlet nozzle secured to the container. The self-orientating nozzle has a housing that has a partial spherical shape. A resilient member having an outlet opening is secured to the housing. The exemplary embodiment further includes a socket for receiving the housing. At least a portion of the housing can rotate within the socket.

Another exemplary wipes dispenser having self-orientating outlet nozzle includes a container for holding a plurality of wipes and a liquid for wetting the wipes and a self-orientating outlet nozzle. The self-orientating outlet nozzle has an outlet opening. A connector for connecting the self-orientating outlet nozzle to the container is also included. The connector is configured so that the outlet of the self-orientating outlet nozzle is moveable with respect to the container and moves so that the opening is aligned with a wipe pull direction when the wipe pull direction is offset from a vertical position.

Another exemplary dispenser for dispensing wipes includes a container, a cap, a plurality of wipes contained within the container, a socket, a housing located at least partially within the socket and an elastomeric outlet nozzle secured to the housing. The elastomeric outlet nozzle has an outlet opening and the housing is configured to self-orientating within the socket.

Another exemplary wipes dispenser includes a container for holding a plurality of wipes and a dispensing self-orientating nozzle secured to the container. The dispensing self-orientating nozzle includes a housing having a partial spherical shape and a resilient member having an outlet opening secured to the housing. The dispenser includes a socket for receiving the housing of the dispensing self-orientating nozzle.

Another exemplary dispensing self-orientating nozzle for wipes includes a resilient dome shaped member, an outlet opening located in the dome shaped member, and a housing having a partial spherical shape. The housing is configured to be received in a socket allowing the outlet opening to self-orientating.

BRIEF DESCRIPTION OF THE DRAWINGS

These and other features and advantages of the present invention will become better understood with regard to the following description, and accompanying drawings where.

DETAILED DESCRIPTION

Figure 1:
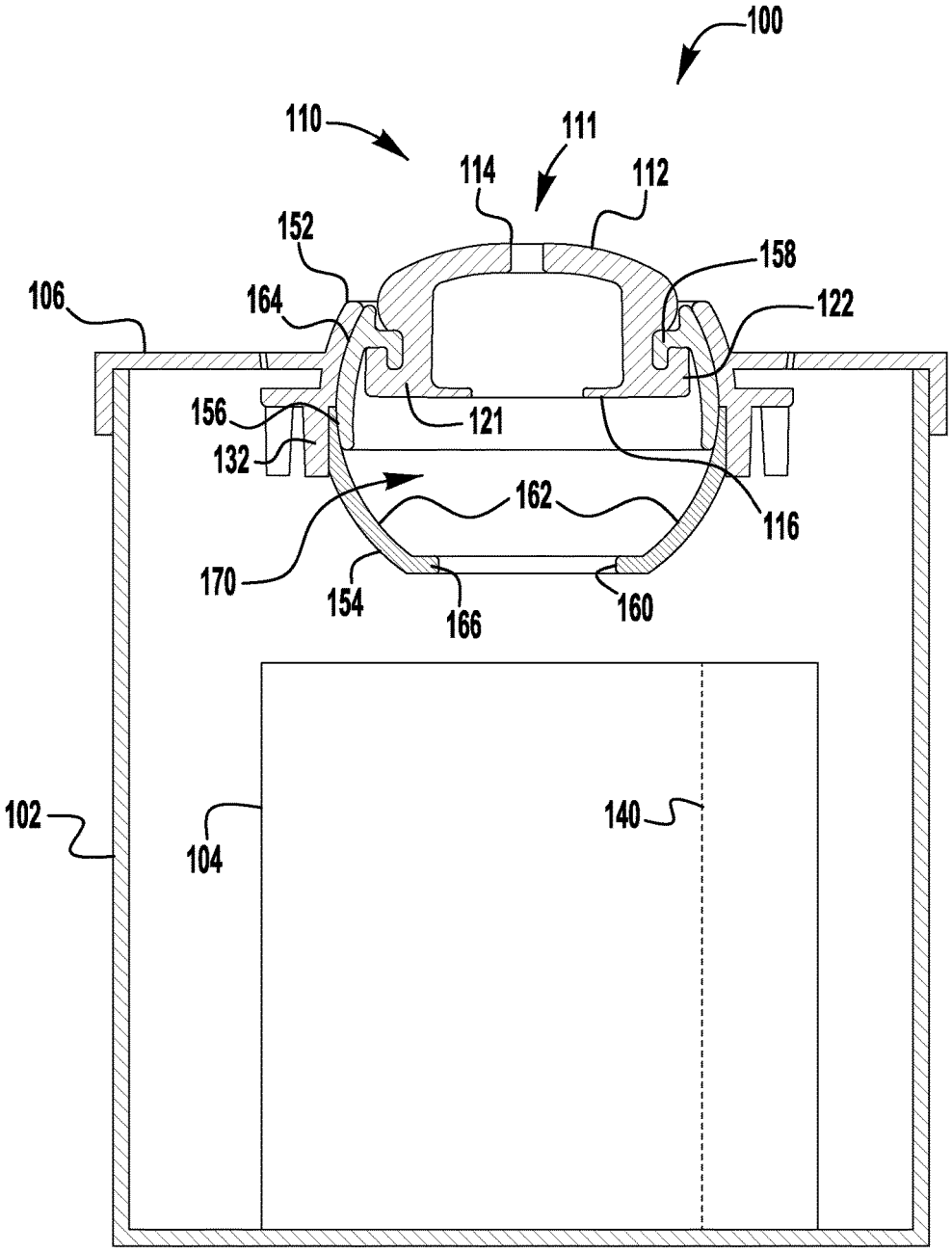
FIG. 1 is a cross-sectional view of an exemplary embodiment of a wipes dispenser having a self-orientating nozzle with the self-orientating nozzle in an upright position.
Figure 2:
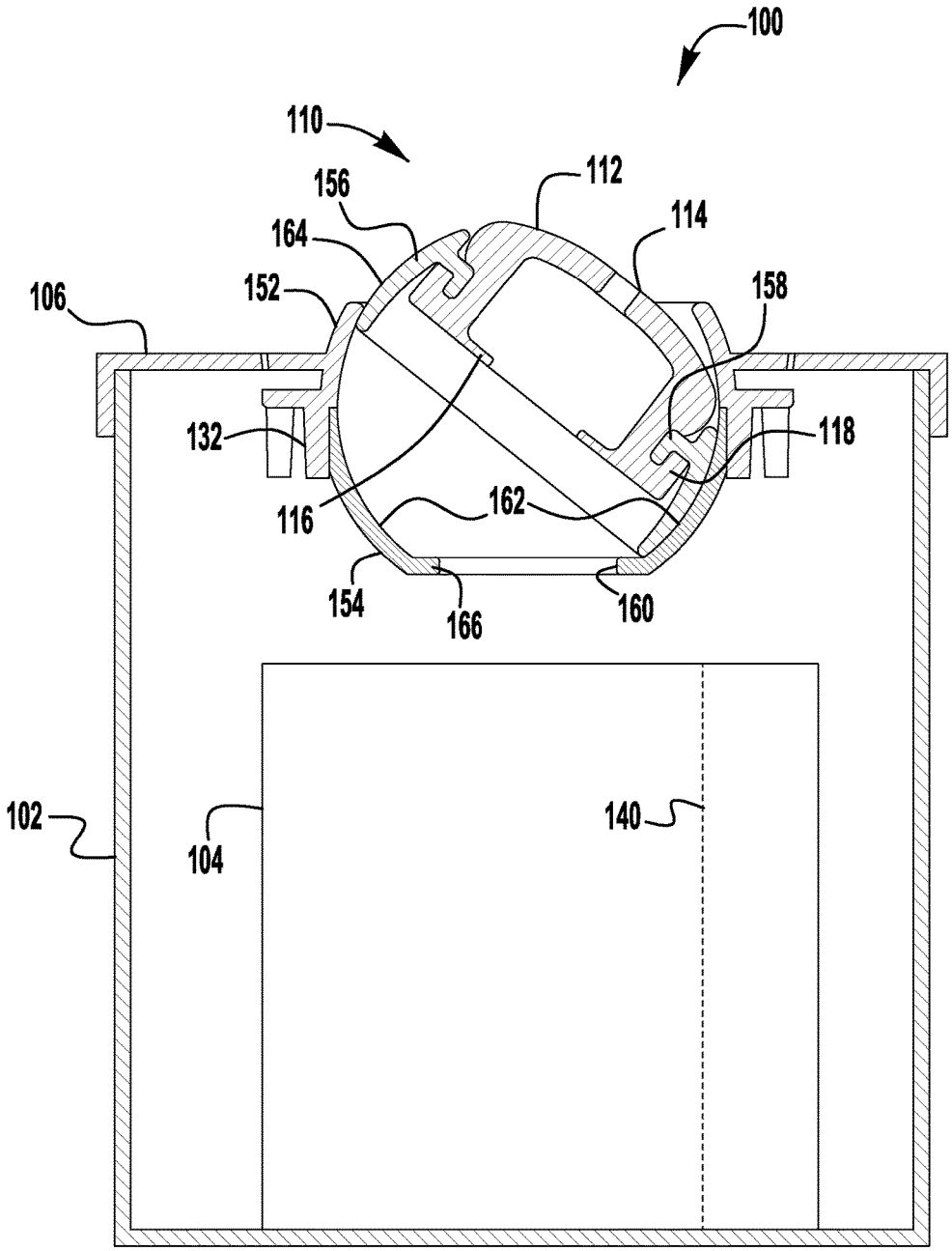
FIG. 2 is a cross-sectional view of an exemplary embodiment of a wipes dispenser having a self-orientating nozzle with the self-orientating nozzle in an oriented position.

FIGS. 1 and 2 illustrate an exemplary embodiment of a wipes dispenser 100. Wipes dispenser 100 includes a container 102. Located inside of container 102 is a roll of wipes 104. The role of wipes 104 has periodic perforations 140 that separate individual wipes and provide tear points that separate the wipe from the role of wipes. In some embodiments, the wipes 104 are individual wipes that are folded together in a manner such that the leading wipe pulls the trailing wipe through the opening before the two wipes separate. Wipes dispenser 100 includes a cap 106 secured to container 102. Cap 106 may be secured to container 102 by any means such as, for example, a threaded connection, a welded connection, a snap-fit connection, an adhesive bonding connection, a friction fit, or the like.

Cap 106 includes an opening 132 formed by cap projection member 152. Cap projection member 152 has a partial spherical shape. A lower member 154 is secured to cap projection member 152. Lower member 154 may be secured to projection member 152 by any means, such as, for example, a threaded fit, a friction fit, an adhesive connection, a snap fit, and the like. Lower projection member 154 also has a partial spherical shape. Cap projection member 152 and lower member 154 form a socket 170 having spherical shaped inside walls 162. Socket 170 includes an opening 160 located in the bottom of the socket 170 to allow wipes to be pulled up through the socket 170 and out of the opening 114 in self-orientating nozzle 110. Also located at the bottom of socket 170 is annular projection 166 that limits the travel of the self-orientating nozzle 110.

Located within socket 170 is self-orientating nozzle housing 156, which also has a partial spherical shape, and forms a portion of a ball 164 that may rotate and self-orientate within socket 170. Annular projection 166 prevents self-orientating nozzle 110 from rotating to far, e.g. from rotating to a point where opening 114 is no longer within opening 132 when self-orientating nozzle housing 156 contacts the annular projection 166.

Self-orientating nozzle housing 156 includes an annular projection 158. Annular projection 158 retains an elastomeric or resilient outlet nozzle member 111 in the self-orientating nozzle housing 156. The elastomeric or resilient outlet nozzle member 111 may be made of, for example, silicon, an elastomer, rubber, plastic, TPE, or the like.

In this exemplary embodiment, outlet nozzle member 111 includes a dome 112 that has a narrow aperture or opening 114 therethrough. In some embodiments, opening 114 has a circular cross-section that may expand as needed to allow a wipe 302 (FIG. 3) to be pulled through the opening 114. In all of the embodiments disclosed herein, the openings are shown as round, however, the openings may be different cross-sectional shapes such as, for example, oval, rectangular, multi-faceted, star shapes, conical shapes, polygonal shapes and the like. In some embodiments, the thickness of the opening may be adjusted to achieve the desired resistance placed on the wipes as they are pulled through.

In this exemplary embodiment, self-orientating nozzle 110 includes an optional fluid retaining member 120. Fluid retaining member 120 is an annular member that has a non-sloped, horizontal surface. In some embodiments, the surface may be sloped upward. In some embodiment, the horizontal surface 120 traps and holds liquid. As shown, fluid retaining member 120 is integrally molded with dome 112; however, fluid retaining member 120 may optionally be a separate piece. Outlet nozzle 110 has an annular projection 121 below the dome 112. The annular projection 121 has an upwardly extending flange 122 on an outer end to connect to annular projection 158 of the self-orientating nozzle housing 156.

Figure 3:
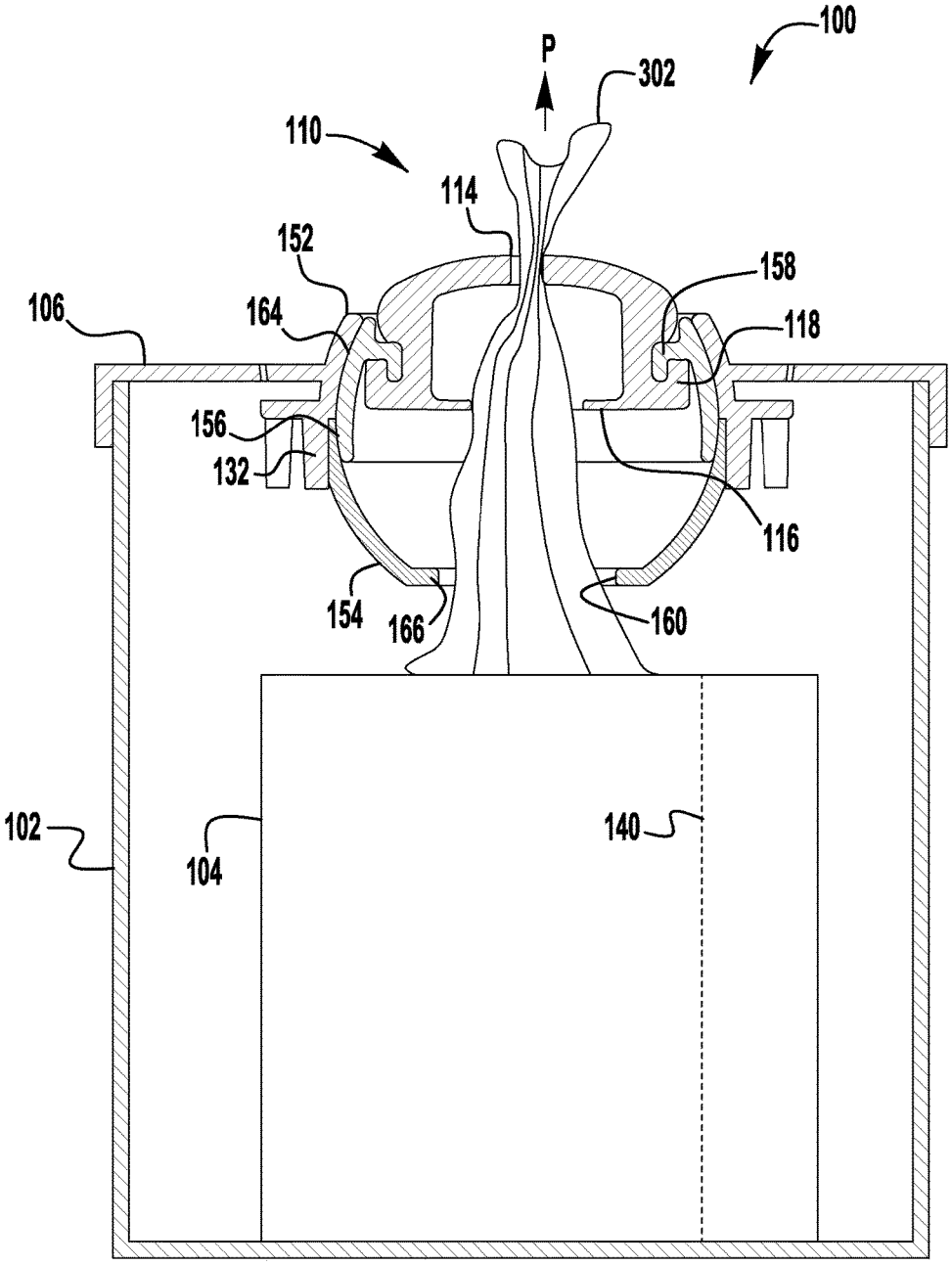
FIG. 3 is a cross-sectional view of the exemplary embodiment of a wipes dispenser having a self-orientating nozzle in an upright position with a wipe extending through the nozzle.
Figure 4:
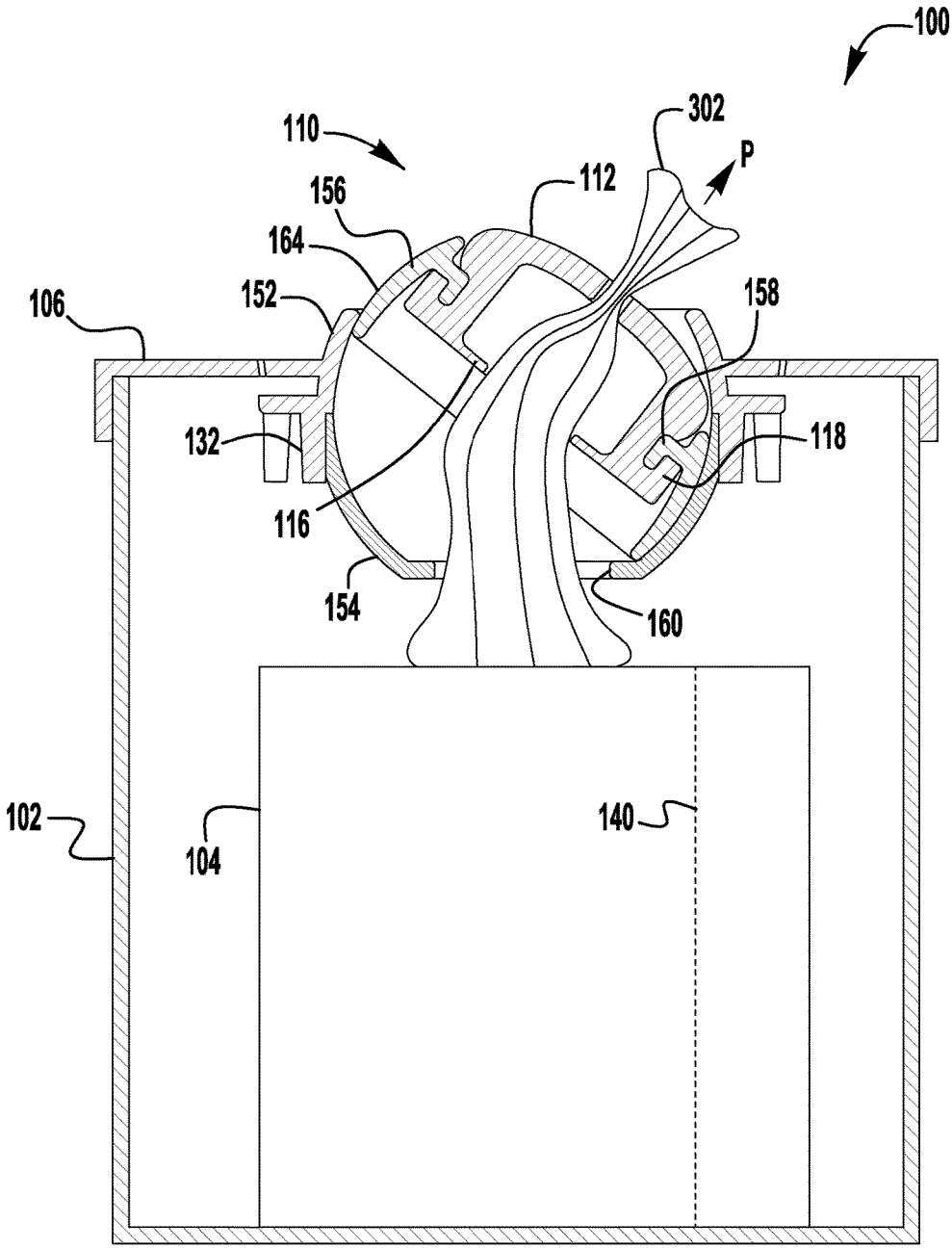
FIG. 4 illustrates a cross-sectional view of an exemplary embodiment of a wipes dispenser having a self-orientating nozzle in an oriented position with a wipe extending through the nozzle.

FIGS. 3 and 4 illustrate the exemplary dispenser 100 having a wipe 302 pulled up through opening 114 in an upward direction (FIG. 3) and also in a non-vertical direction (FIG. 4). During operation, wipe 302 is pulled up through self-orientating nozzle 110. As wipe 302 is pulled up through narrow opening 114 of self-orientating nozzle 110, liquid is squeezed or rung out of the wipe 302. The liquid travels along the inside of dome 112 and runs down to fluid retaining member 120. The liquid contacts a portion of the wipe 302 that is passing by fluid retaining member 120 to re-wet the wipe 302. Thus, fluid retaining member 120 helps ensure that all of the wipe 302 is wet. In addition, fluid retaining member 120 may hold liquid for a longer period of time and help keep the wipe 302 from drying out between uses. In some embodiments, fluid retaining member 120 and the size of opening 114 combine to eliminate the need for a re-closable cover (not shown) to be disposed over self-orientating nozzle 110 and supporting ring 150.

In addition, during operation when wipe 302 is pulled out of the self-orientating nozzle 110, the self-orientating nozzle 110 is free to rotate or swivel in socket 170. Accordingly, the opening 114 of self-orientating nozzle 110 aligns with the direction of pull (P). FIG. 3 illustrates how the self-orientating nozzle 110 aligns when the direction of pull (P) is upward. FIG. 4 illustrates how the self-orientating nozzle 110 aligns when the direction of pull (P) is off to the side.

It has been discovered that when the self-orientating nozzle 110 aligns with the direction of pull, the number of short tails, i.e. the leading edge of the wipe not being far enough out of the opening 114 for a user to be able to grab hold of to pull the wipe out of the container is reduced.

Figure 4A:
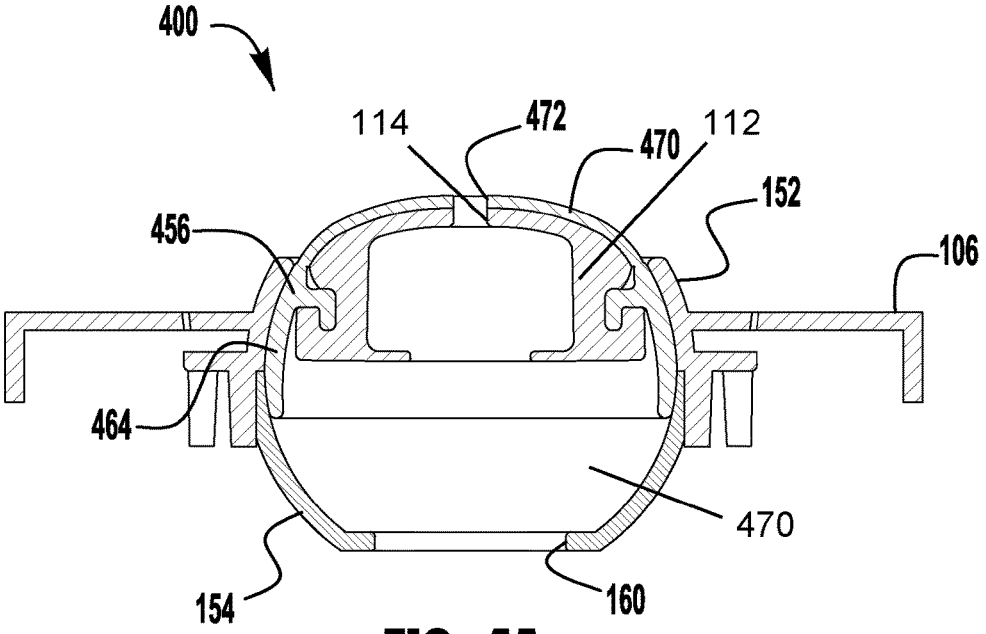
FIG. 4A illustrates a cross-sectional view of another exemplary embodiment of a wipes dispenser having a self-orientating nozzle.

FIG. 4A is cross-sectional view of another exemplary embodiment of a self-orientating nozzle 400. Self-orientating nozzle 400 includes cap 106 includes an opening 132 formed by cap projection member 152. Cap projection member 152 has a partial spherical shape. A lower member 154 is secured to cap projection member 152. Lower member 154 may be secured to projection member 152 by any means, such as, for example, a threaded fit, a friction fit, an adhesive connection, a snap fit, and the like. Lower projection member 154 also has a partial spherical shape. Cap projection member 152 and lower member 154 form a socket 470 having spherical shaped inside walls and form an opening 160 located in the bottom of the socket 470 to allow wipes to be pulled up through the socket 470. Located within socket 470 is self-orientating nozzle housing 456, which also has a partial spherical shape, and forms a portion of a ball 464 that may rotate and self-orientate within the socket formed by projection member 152 and lower projection member 154. Self-orientating nozzle housing 400 includes an upper surface 470 that encloses outlet nozzle 112 and has an opening 472 located above opening 114 in outlet nozzle 112. In some embodiments, opening 472 has a diameter that is the same size as the diameter of opening 114. In some embodiments, opening 472 has a diameter that is slightly larger than the diameter of opening 114. In some embodiments, opening 472 has a diameter that is smaller than the diameter of opening 114. In some embodiments, upper surface 470 provides wear protection that extends the life of outlet nozzle 112. Self-orientating nozzle 400 self-orientates in the direction of pull of the wipe as described above.

Figure 5:
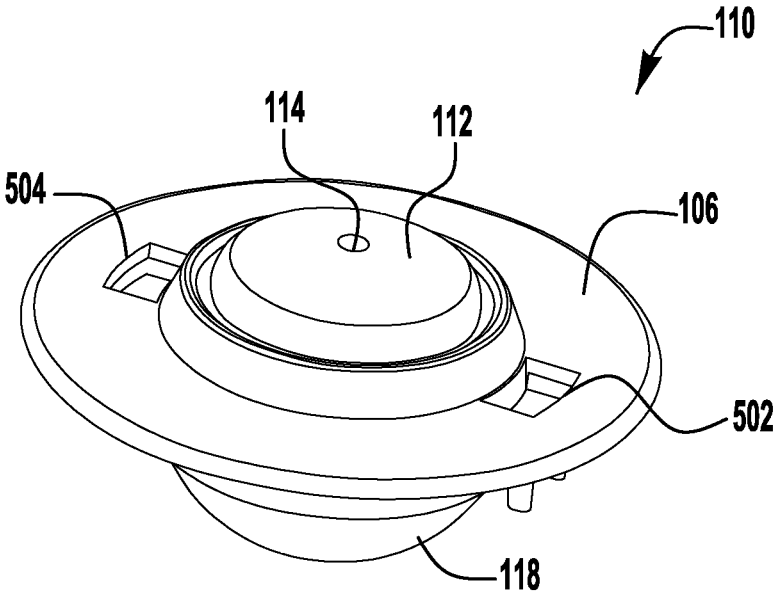
FIG. 5 is a prospective view of a cap for a wipes dispenser having a self-orientating nozzle with the self-orientating nozzle in an upright position.
Figure 6:
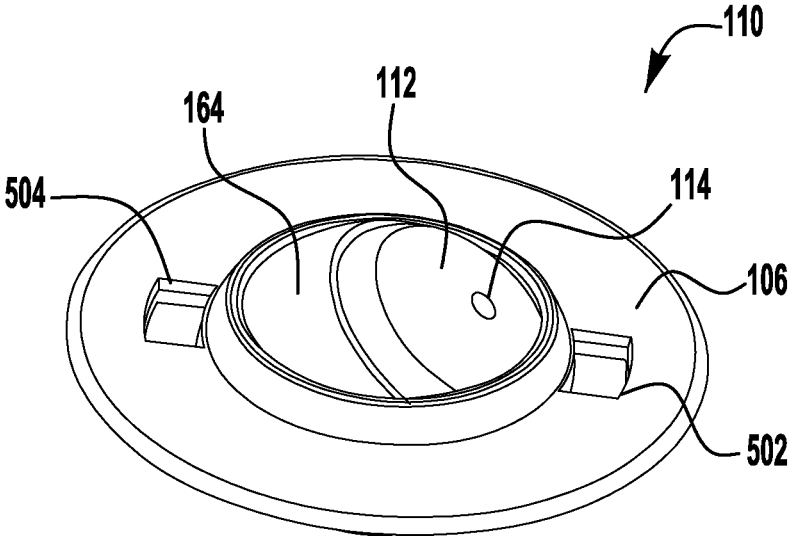
FIG. 6 is a prospective view of the cap for a wipes dispenser of FIG. 5 having a self-orientating nozzle with the self-orientating nozzle in an oriented position.

FIG. 5 is a perspective view of the self-orientating nozzle 114 in cap 106 with the outlet opening 114 oriented an upward position and FIG. 6 is a perspective view of the self-orientating nozzle 144 in cap 106 with outlet opening 114 of the self-orientating nozzle 110 in a off-vertical orientation.

In some embodiments, cap 106 may include a cover (not shown), such as, for example, a snap cover. If a cover is provided, a hinged member may connect to opening 502 (FIG. 5) on a first side of the cover and the closure of the cover, such as a snap connector, would releasably connect to slot 504 in the cap 106 to maintain the cover in a closed position. In embodiments where no cover is used, opening 502 and slot 504 may be eliminated.

Figure 7:
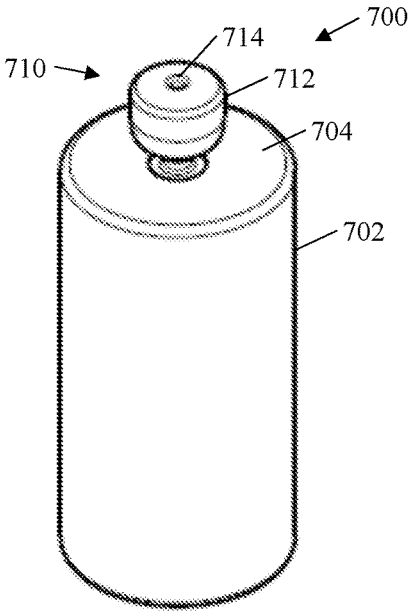
FIG. 7 is a prospective view of another exemplary embodiment of a wipes dispenser having an self-orientating nozzle.
Figure 8:
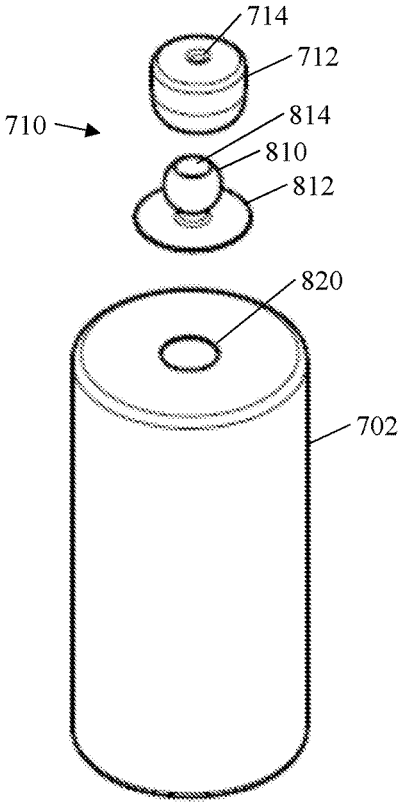
FIG. 8 is an exploded prospective view of the exemplary wipes dispenser of FIG. 7.
Figure 9:
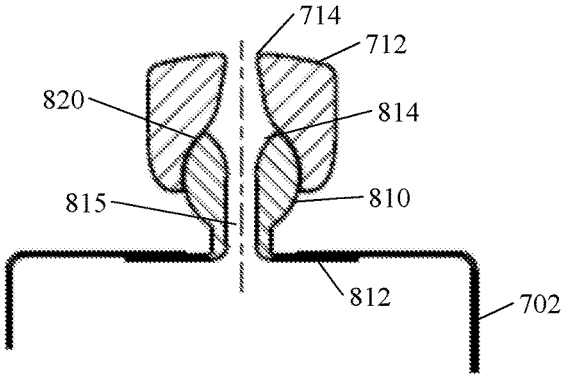
FIG. 9 is a partial cross-sectional view of the exemplary wipes dispenser of FIG. 7.

FIGS. 7-9 illustrate another exemplary embodiment of a wipes dispenser 700 having a self-orientating outlet nozzle 710. Wipes dispenser 700 includes a container 702 having a cap 704. Cap 704 includes an aperture 820 therethrough. Self-orientating outlet nozzle 710 is a ball and socket type system having a ball 810 and a socket 820 that is formed in swivel member 712. Swivel member 712 has an opening 714 therethrough. As can be better seen in FIG. 9, opening 714 expands inside of swivel member 712 and forms socket 820 therein. Ball 810 includes a base 812 that may be secured to cap 704. In this exemplar embodiment, ball 810 has a passageway 815 therethrough. Passageway 815 has an opening 810 on the top of ball 810. Opening 810 flares outward at the top. Accordingly, as a wipe is pulled through (from vertical directions and/or non-vertical directions), the flared rounded opening 814 allows the wipe to flow smoothly and limits any additional forces on the wipes. Swivel member 712 is configured to move and align with the direction of pull of a wipe passing through the self-orientating outlet nozzle 710. Accordingly, as a wipe is pulled through self-orientating outlet nozzle 710, the opening automatically self-orientates to be aligned in the direction of pull. As described above, the exemplary wipes dispensers disclosed herein may include a roll of wipes and a wipe solution. In some embodiments, wipes dispensers include folded wipes and a wipe solution.

Figure 10:
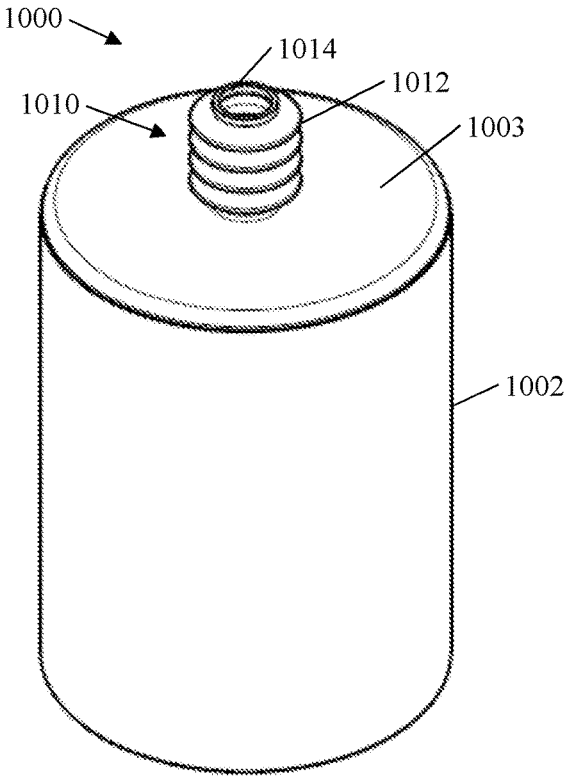
FIG. 10 is a prospective view of another exemplary embodiment of a wipes dispenser having an self-orientating nozzle.
Figure 11:
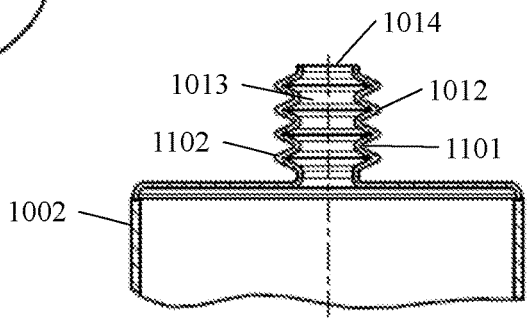
FIG. 11 is a partial cross-sectional view of the exemplary wipes dispenser of FIG. 10.

FIGS. 10-11 illustrate another exemplary embodiment of a wipes dispenser 1000 having a self-orientating outlet nozzle 1010. Wipes dispenser 1000 includes a container 1002. A cap 1003 is included and is secured to the container 1002 in any manner, such as, for example, those described above. In this exemplary embodiment, self-orientating outlet nozzle 1010 is a bellows style self-orientating outlet nozzle. Bellows 1012 is connected to, or integrally formed with cap 1003. Bellows 1002 may be made of any suitable material, such as, for example, plastic, a thermoplastic, an elastomer, rubber, or the like. Bellows 1012 includes a passageway 1013 therethrough and an outlet opening 1014.

As a wipe (not shown) is pulled through passageway 1013, self-orientating outlet nozzle 1010 is configured to flex or bend toward the direction of pull on the wipe. Accordingly, if the wipe is pulled straight upward, the self-orientating outlet nozzle 1010 will remain in substantially the position shown. If the wipe (not shown) is pulled out at an angle, the self-orientating outlet nozzle 1010 will bend and the outlet opening 1014 will be pointed in, or aligned in, substantially the direction as the direction of pull of the wipe.

In addition, in this exemplary embodiment, ribs 1101 may be configured to wipe excess liquid from the wipe (not shown) as it is pulled past. In addition, in some embodiments, excess liquid may be retained in valleys 1102. Liquid retained in valleys 1102 may ensure that liquid is contacting the wipe on its way through ensuring that the wipe is completely wetted as it is dispensed.

Figure 12:
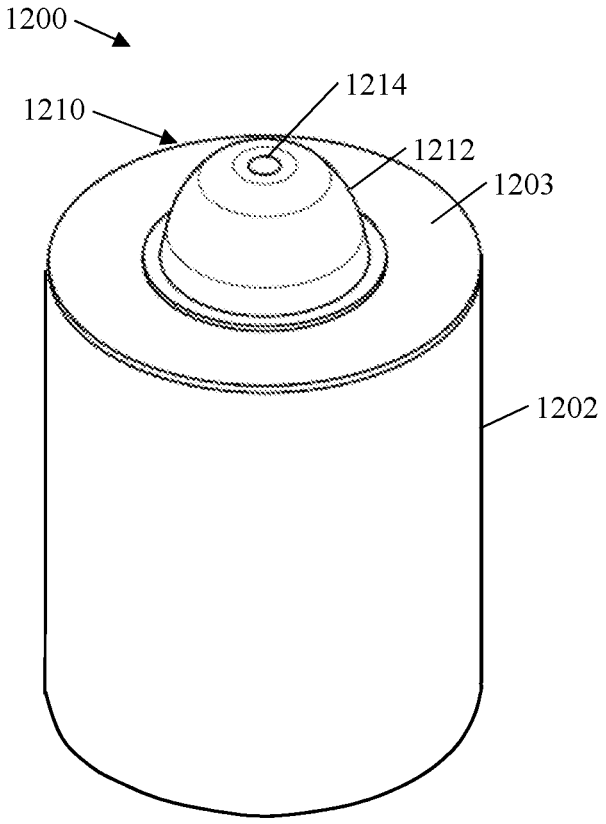
FIG. 12 is a prospective view of another exemplary embodiment of a wipes dispenser having an self-orientating nozzle.
Figure 13:
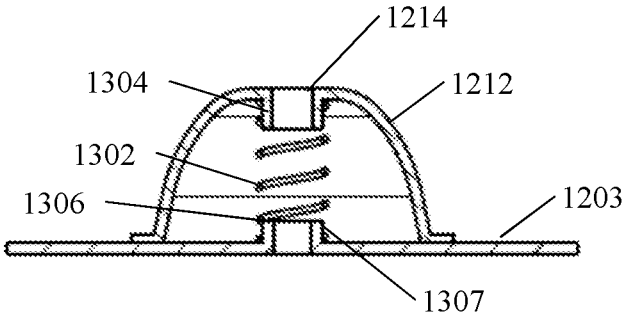
FIG. 13 is a partial cross-sectional view of the exemplary wipes dispenser of FIG. 12.

FIGS. 12 and 13 illustrate another exemplary embodiment of a wipes dispenser 1200 having a self-orientating outlet nozzle 1210. Wipes dispenser 1200 includes a container 1202. A cap 1203 is secured to the container 1202. Cap 1203 is secured to container 1202 in any, such as, for example, those described above. In this exemplary embodiment, self-orientating outlet nozzle 1210 is a diaphragm style self-orientating outlet nozzle. Cap 1203 includes an aperture 1306 surrounded by annular projection 1307. A flexible diaphragm 1212 is secured to cap 1203. Flexible diaphragm 1212 may be made of any flexible material, such as, for example, silicon, rubber, plastic, thermoplastic and the like. Flexible diaphragm 1212 includes an opening 1214 and an annular projection 1304. A biasing member 1302, such as, for example, a spring, is located in the interior of flexible diaphragm 1212 and is retained in position by annular projection 1307 and annular projection 1304. Biasing member 1302 is configured to exert sufficient force to urge flexible diaphragm 1202 to its upright position as shown.

During operation, a wipe (not shown) is threaded up through aperture 1306 and opening 1214. If the wipe is pulled upward vertically, opening 1214 remains in the position shown as it is aligned in the direction of the wipe pull. If the wipe is pulled up at an angle, opening 1214 self-orientates in the direction of the wipe pull because the flexible diaphragm 1212 and biasing member 1302 are configured to allow the opening 1214 to move in order to align with the direction of wipe pull.

Figure 14:
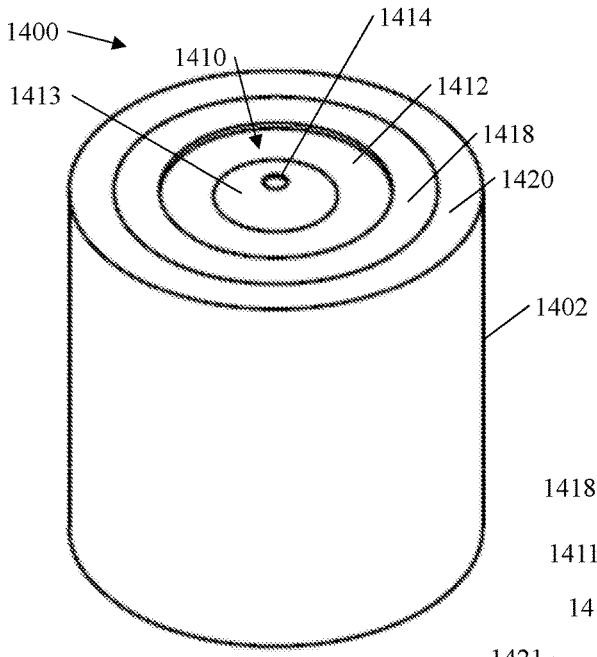
FIG. 14 is a prospective view of another exemplary embodiment of a wipes dispenser having an self-orientating nozzle.
Figure 15:
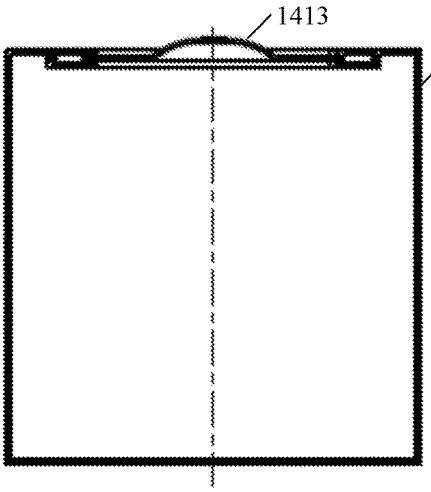
FIG. 15 is a cross-sectional view of the exemplary wipes dispenser of FIG. 14.
Figure 16:
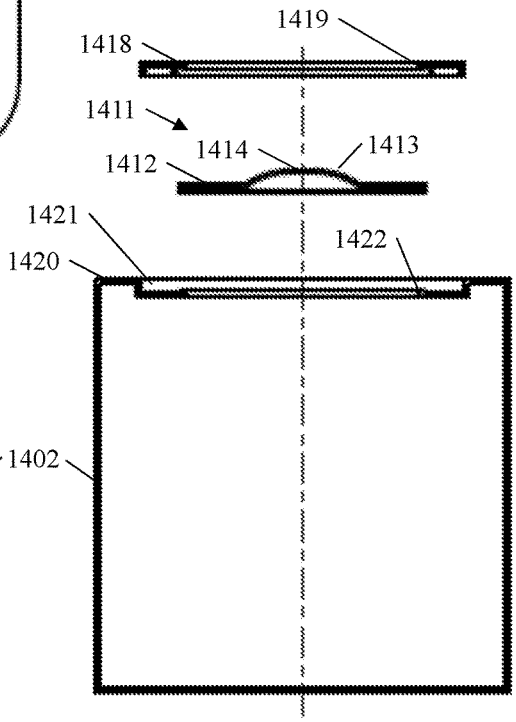
FIG. 16 is an exploded cross-sectional view of the exemplary wipes dispenser of FIG. 14.

FIGS. 14-16 illustrate another exemplary embodiment of a wipes dispenser 1400 having a self-orientating outlet nozzle 1410. Wipes dispenser 1400 includes a container 1402. A cap 1420 is secured to the container 1402. Cap 1420 is secured to container 1402 in any manner, such as, for example, those described above. In this exemplary embodiment, self-orientating outlet nozzle 1410 is an elastomeric style self-orientating outlet nozzle. Cap 1420 includes an aperture 1422 surrounded by a recessed receiving area 1421 for receiving retaining member 1418. Retaining member 1418 includes an opening 1419. In some embodiments, a cap is not required and the structure shown and described is molded as part of the container 1402. Retaining member 1418 retains flexible nozzle member 1411 in place. Flexible nozzle member 1411 may be made of any flexible material, such as, for example, silicon, rubber, plastic, thermoplastic and the like. Flexible nozzle member 1411 includes an opening 1414. In some embodiments, flexible nozzle member 1411 includes a domed portion 1414. In some embodiments, domed portion 1414 is formed of the same flexible material that forms flexible nozzle member 1414. In some embodiments, domed portion 1414 is formed of the same material, however, the material is thicker in the domed area. In some embodiments, domed portion 1414 is formed of a second material (not shown) or reinforced material. In some embodiments, domed portion 1414 is formed of a second material (not shown) located on top or on bottom of the flexible nozzle member 1414. In some embodiments, domed portion 1414 is formed of a second material (not shown) located on top and on bottom of the flexible nozzle member 1414.

During operation, a wipe (not shown) is threaded up through opening 1414. If the wipe is pulled upward vertically, opening 1414 remains in the position shown as it is aligned in the direction of the wipe pull. If the wipe is pulled up at an angle, opening 1414 self-orientates in the direction of the wipe pull because the flexible nozzle member is very flexible and configured to allow the dome portion 1414 to tilt so that the opening 1414 may move and align with the direction of wipe pull.

Figure 17:
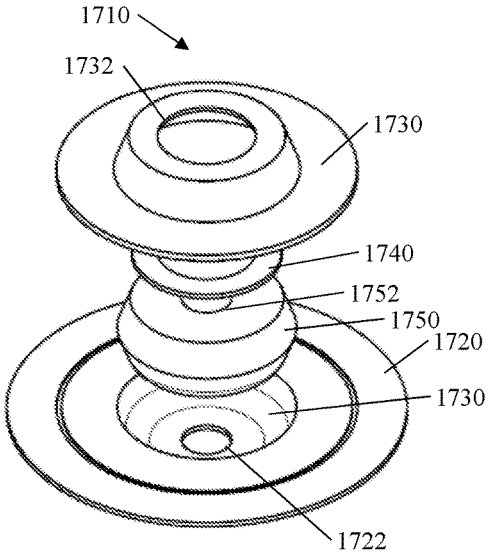
FIG. 17 is a prospective view of another exemplary embodiment of a self-orientating nozzle.
Figure 19:
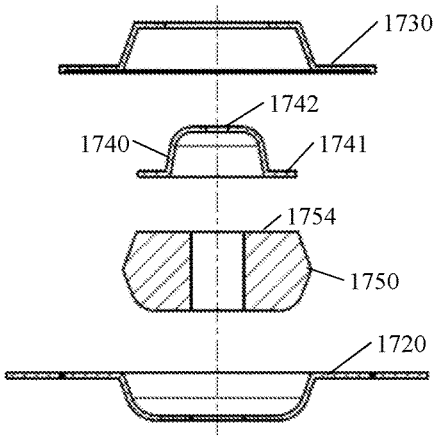
FIG. 19 is an exploded cross-sectional view of the self-orientating nozzle of FIG. 17.
Figure 18:
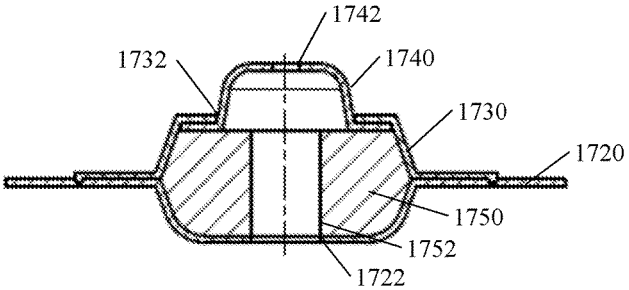
FIG. 18 is a cross-sectional view of the exemplary self-orientating nozzle of FIG. 17.

FIGS. 17-19 illustrate another exemplary embodiment of a self-orientating outlet nozzle 1710 for a wipes dispenser (not shown). A cap 1720 is secured to the container (not shown). Cap 1420 may be secured to container 1402 in any manner, such as, for example, those described above, or may be integrally molded into the container. In this exemplary embodiment, self-orientating outlet nozzle 1710 is flexing self-orientating outlet nozzle. Cap 1420 includes an aperture 1722 located in the bottom of a recessed receiving area 1730. Located inside of receiving area 1730 is resilient member 1750. Resilient member 1750 includes an opening 1752 therethrough. Resilient member 1750 may be any type of resilient member 1750 that may be compressed and once compressed it attempts to return to its uncompressed state. In some embodiments, resilient member 1750 is a sponge. Resilient member 1750 includes a contact surface 1750. Self-orientating outlet nozzle 1710 includes an outlet member 1740 that has an annular projection 1740 that contacts contact surface 1750 of resilient member 1750. In this exemplary embodiment, outlet member 1740 has a dome shape and has an outlet aperture 1742 located at its top. A retaining member 1730 is provided. Retaining member 1730 includes an annular projection 1732 that may contact a top surface of annular projection 1741 and is configured to retain outlet member 1740. Resilient member 1750 may be compressed by pressure exerted by portions of contact surface 1741, which allows outlet member 1730 to tilt and thereby allows outlet opening 1742 to self-orientate in the direction of wipe pull.

For example, during operation, a wipe (not shown) is threaded up through opening 11742. If the wipe is pulled upward vertically, opening 1742 remains in the position shown as it is aligned in the direction of the wipe pull. If the wipe is pulled up at an angle, opening 1742 self-orientates in the direction of the wipe pull because the resilient member 1750 is easily compressible and is configured to allow the outlet member 1740 to tilt so that the opening 1742 may move and align with the direction of wipe pull.

Figure 20:
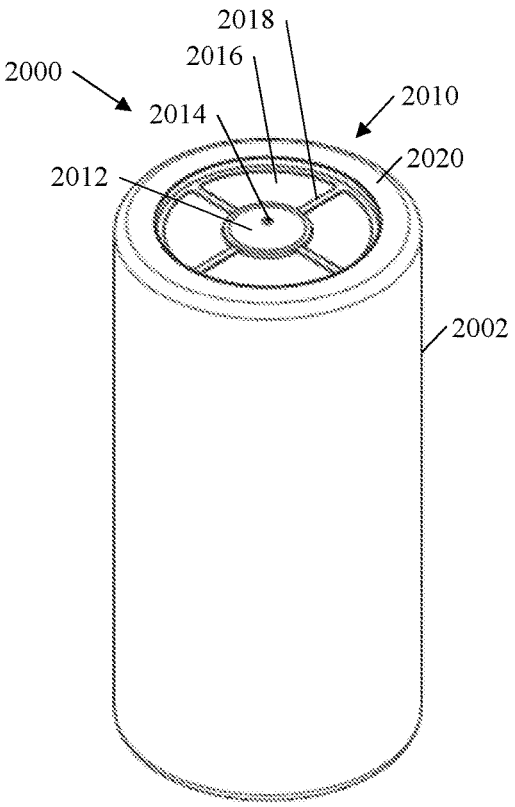
FIG. 20 is a prospective view of another exemplary embodiment of a dispenser having a self-orientating nozzle.
Figure 21:
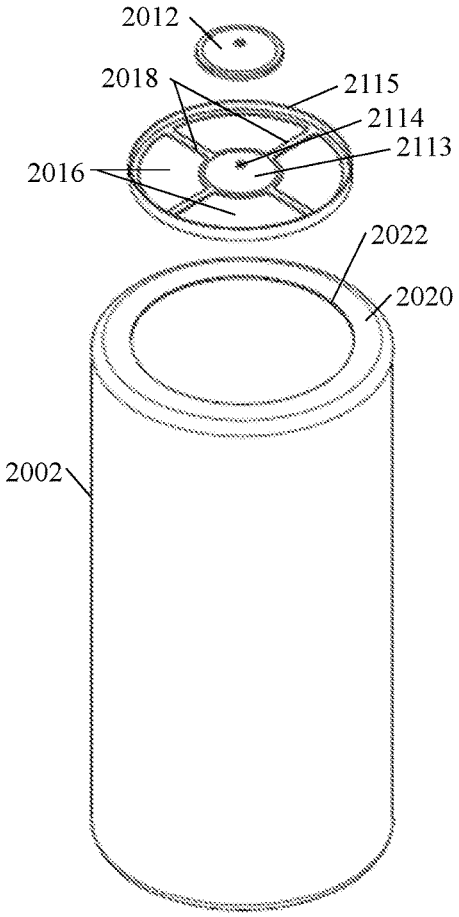
FIG. 21 is an exploded view of the dispenser and self-orientating nozzle of FIG. 20.
Figure 22:
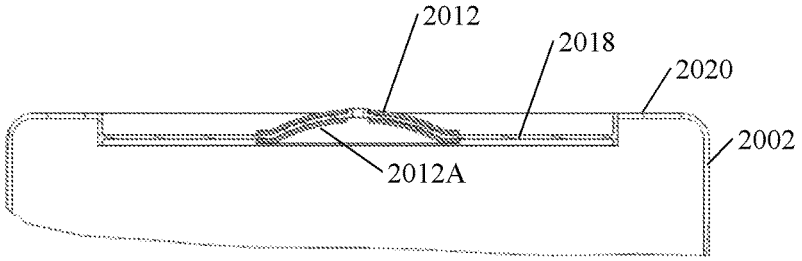
FIG. 22 is a partial cross-sectional view of the exemplary dispenser and self-orientating nozzle of FIG. 20.

FIGS. 20-22 illustrate another exemplary embodiment of a wipes dispenser 2000 having a self-orientating outlet nozzle 2010. Wipes dispenser 2000 includes a container 2002. A cap 2020 is secured to the container 2002. Cap 2020 is secured to container 2002 in any manner, such as, for example, those described above. In some embodiments, a cap is not needed and the structure shown and described as a cap are integrally molded into the container 2002. In this exemplary embodiment, self-orientating outlet nozzle 2010 is an elastomeric style self-orientating outlet nozzle. Cap 2020 includes an aperture 2022 that is configured to receive and retain flexible nozzle member 2011. In some embodiments, flexible nozzle member 2011 includes a retaining member 2115. Retaining member 2115 may be a separate piece connected to flexible nozzle member 2011 or may be integrally molded to flexible nozzle member 2011. Retaining member 2018 includes an opening 2019. Retaining member 2018 retains flexible nozzle member 2011 in place.

Flexible nozzle member 2011 may be made of any flexible material, such as, for example, silicon, rubber, and the like. Flexible nozzle member 2011 has a center portion 2113 and multiple spokes 2018. In some embodiments, the area 2016 between the spokes 2018 is open. In some embodiments, the area 2016 between the spokes is a thin highly flexible portion of the flexible nozzle member 2011, which serves to retain moisture in dispenser 2002. The spokes 2018 are elastic and allow the center portion 2113 to tilt and move in multiple directions.

Flexible nozzle member 2011 includes an opening 2014 in center portion 2113. In some embodiments, center portion 2113 has a dome shape. In some embodiments, center portion 2014 is formed of the same flexible material that forms flexible nozzle member 2014. In some embodiments, center portion 2014 is formed of the same material, however, the material is thicker in the domed area. In some embodiments, center portion 2014 is formed of a second material (not shown) or reinforced material. In some embodiments, center portion 2014 is formed of a second 2012 located on top or on bottom of the center portion 2014 flexible nozzle member 2014. In some embodiments, domed portion 2014 is formed of a second material 2012 located on top and a second material 2012A on bottom of the center portion 2014 of flexible nozzle member 2014.

During operation, a wipe (not shown) is threaded up through opening 2014. If the wipe is pulled upward vertically, opening 2014 remains in the vertically orientated position shown as it is aligned in the direction of the wipe pull. If the wipe is pulled up at an angle, opening 2014 self-orientates in the direction of the wipe pull because the flexible nozzle member 2011 is very flexible and configured to allow the dome portion 2014 to tilt so that the opening 2014 may move and align with the direction of wipe pull.

Figure 23:
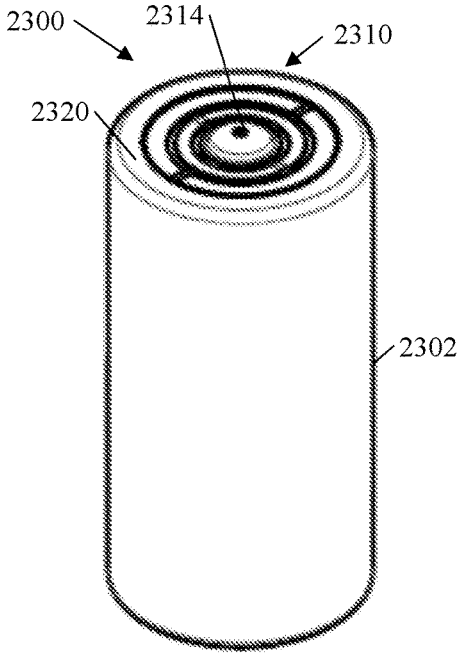
FIG. 23 is a prospective view of another exemplary embodiment of a dispenser having a self-orientating nozzle.
Figure 24:
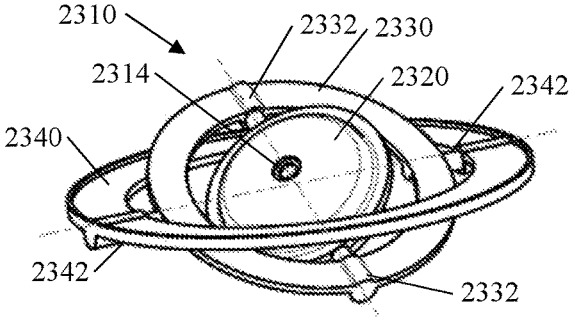
FIG. 24 is an enlarged prospective view of the self-orientating nozzle of FIG. 23.
Figure 25:
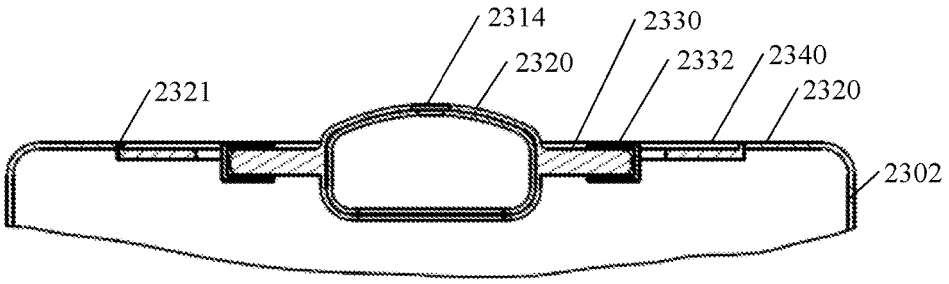
FIG. 25 is a partial cross-sectional view of the exemplary dispenser and self-orientating nozzle of FIG. 23.

FIGS. 23-25 illustrate another exemplary embodiment of a wipes dispenser 2300 having a self-orientating outlet nozzle 2310. Wipes dispenser 2300 includes a container 2302 having a cap 2320. Cap 2320 includes an aperture 2321 therethrough. Self-orientating outlet nozzle 2310 is secured to cap 2320. Cap 2320 is secured to container 2202 in any manner, such as, for example, those described above. In some embodiments, a cap 23020 is not needed and the structure shown and described as a cap are integrally molded into the container 2302. In this exemplary embodiment, self-orientating outlet nozzle 2310 is a multiaxial rotating member type self-orientating outlet nozzle 2301. Self-orientating outlet nozzle 2310 includes a flexible nozzle member 2320 that includes an opening 2314 that serves as a wipes outlet. Flexible nozzle member 2320 may be, for example, similar or substantially the same as outlet nozzle member 111 described above modified as required to accommodate being hingedly connected to first platform 2330 with hinges 2332. First platform 2330 is hingedly connected to second platform 240 through hinges 2342. Second platform 2340 is connected to cap 2320 in any manner, such as, for example, a snap-fit connection, a welded connection, a screwed connection, a friction fit connection or the like. Although the exemplary embodiment shows and describes two rotational axes, in some embodiment, there is only one rotational axis and no need for the second platform. In some exemplary embodiments, there are more than two rotational axes and accordingly, more than two platforms.

During operation, a wipe (not shown) is threaded up through opening 2314. If the wipe is pulled upward vertically, opening 2314 remains in the vertically orientated position shown in FIG. 23 as it is aligned in the direction of the wipe pull. If the wipe is pulled up at an angle, such as, for example, the angle of the opening 2314 shown in FIG. 24, the opening 2314 self-orientates in the direction of the wipe pull because the self-orientated outlet nozzle 2310 has the ability for multiaxial rotation and the opening 2314 may move and align with the direction of wipe pull.

Figure 26:
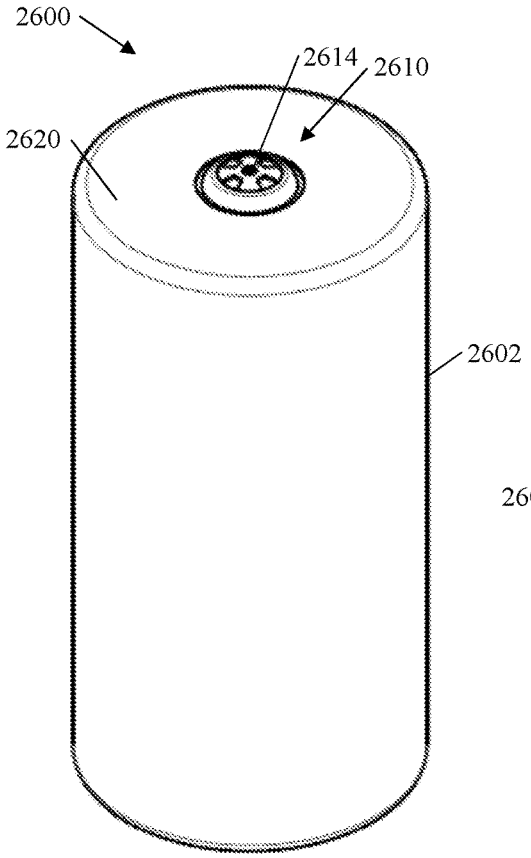
FIG. 26 is a prospective view of another exemplary embodiment of a dispenser having a self-orientating nozzle.
Figure 27:
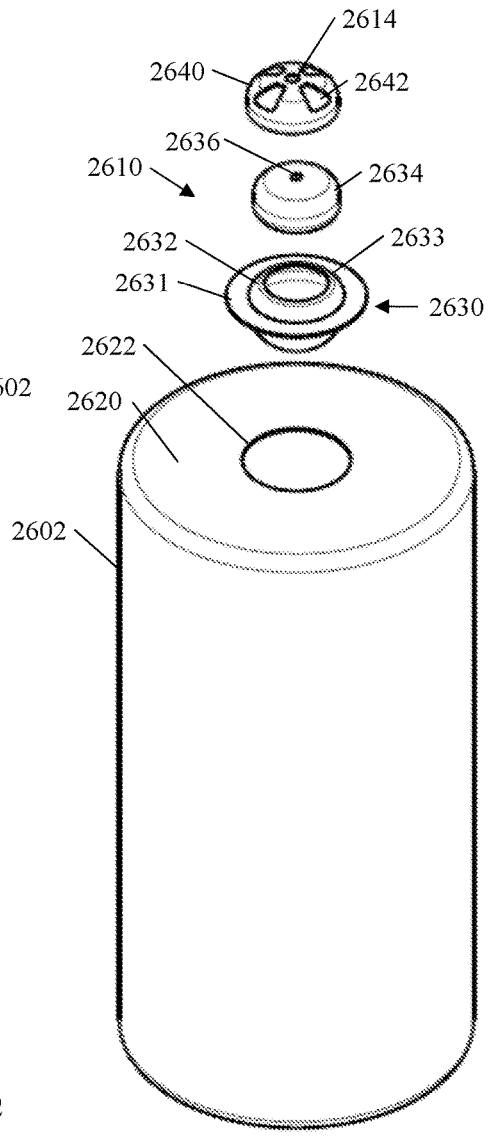
FIG. 27 is an exploded view of the dispenser and self-orientating nozzle of FIG. 26.
Figure 28:
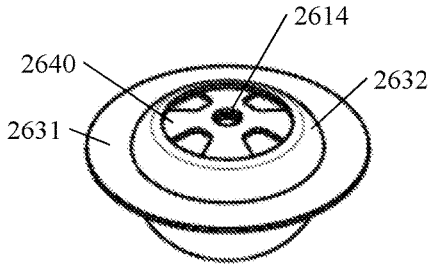
FIG. 28 is an enlarged prospective view of the exemplary self-orientating nozzle of FIG. 26.

FIGS. 26-28 illustrate yet another exemplary embodiment of a dispenser 2600 having a self-orientating outlet nozzle 2610). A cap 2620 is secured to the container (not shown). Cap 2620 may be secured to container 2602 in any manner, such as, for example, those described above, or may be integrally molded into the container. In some embodiments, a cap is not used and the structure described herein is integrally molded with container 2602. In this exemplary embodiment, self-orientating outlet nozzle 2610 is swivel type self-orientating outlet nozzle. Cap 2620 includes an aperture 2622 for receiving a swivel socket 2603. Swivel socket 2630 includes a spherical body 2632 that is hollow and has an opening 2633 in the top and an opening (not shown) in the bottom. Receiving swivel socket 2603 includes annular projection 2631 for connecting swivel socket 2630 to cap 2620 or container 2602. A flexible nozzle member 2634 that includes an opening 2636 that serves as a portion of the wipes outlet. Flexible nozzle member 2620 may be, for example, similar or substantially the same as outlet nozzle member 111 described above with any necessary modifications for working in this exemplary embodiment. Because flexible nozzle member 2620 is flexible, it can be worked through the opening in swivel socket 2630. An outlet nozzle guard 2640 is also included. Outlet nozzle guard 2640 is preferably flexible enough to be manipulated through opening 2632 and return to its normal shape so that it retains itself and flexible nozzle member 2620 within swivel socket 2630. Swivel socket 2630 and outlet nozzle guard 2640 may be made of any material that allows for easy movement of outlet nozzle guard 2640 within the interior of swivel socket 2630. Nozzle guard 2640 includes an aperture 2614 and may include one or more openings 2642. In some embodiments, openings 2642 add to the flexibility of outlet nozzle guard 2630. In some embodiments, opening 2614 is the same size as opening 2636. In some embodiments, opening 2614 is larger than opening 2636. In some embodiments, opening 2614 is smaller than opening 2636. In some embodiments, opening 2614 in outlet nozzle guard 2640 serves as a wear guard and eliminates or slows wear of opening 2636.

During operation, a wipe (not shown) is threaded up through opening 2630 and opening 2614. If the wipe is pulled upward vertically, openings 2630, 2614 remain in the position shown as it is aligned in the direction of the wipe pull. If the wipe is pulled up at an angle, openings 2630, 2614 self-orientate in the direction of the wipe pull because self-orientating outlet nozzle 2610 freely rotates so that openings 2630, 2614 move and align with the direction of wipe pull.

In some embodiments, the containers contain a fluid for wetting the wipes. In some embodiments, the fluid is a sanitizer. In some embodiments, the fluid is an antimicrobial. In some embodiments, the fluid is a disinfectant. In some embodiments, the fluid includes an alcohol. In some embodiments, the fluid includes ethanol. In some embodiments, the fluid includes isopropyl alcohol. In some embodiments, the fluid includes denatured ethanol. In some embodiments, the fluid includes a quat. In some embodiments, the fluid includes a quaternary ammonium cation or salt. In some embodiments, the fluid includes a bleach.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the fluid retaining member may be separate from the dome self-orientating nozzle. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A wipes dispenser comprising:

a container;

the container having an opening at the top of the container;

a lid connectable to the top of the container to at least partially cover the opening;

the container having a sealed bottom;

a plurality of wipes contained within the container;

the plurality of wipes connected to one another in a roll having a cylindrical shape;

the roll having an opening in the center;

the plurality of wipes separated from one another by a perforated line;

a fluid for wetting the plurality of wipes;

wherein the fluid is contained at the bottom of the container and wicks up the plurality of wipes;

a self-orientating outlet nozzle located in the lid of the container;

the self-orientating outlet nozzle having an inlet opening that is located over the top of the opening in the center of the roll;

wherein the self-orientating outlet nozzle comprises a moveable outlet opening;

wherein the moveable outlet opening aligns with the direction of pull of the wipe when the wipe is pulled out of the dispenser at an angle that is not substantially vertical;

wherein the self-orientating outlet nozzle is configured to allow the wipe to be pulled out of the self-orientating outlet nozzle when the outlet nozzle is at an angle offset from a vertical angle; and wherein the self-orientating nozzle is configured to rotate toward any point around the circumference of the lid.

2. The dispenser of claim 1 wherein self-orientating outlet nozzle further comprises a ball and a socket.

3. The dispenser of claim 1 wherein self-orientating outlet nozzle further comprises one or more hinges about which the self-orientating outlet nozzle rotates.

4. The dispenser of claim 1 wherein self-orientating outlet nozzle further comprises a bellows.

5. The dispenser of claim 1 wherein self-orientating outlet nozzle further comprises a flexible dome.

6. The dispenser of claim 1 wherein self-orientating outlet nozzle further comprises an elastomeric member that allows an opening in the self-orientating outlet nozzle to align with the direction of pull of a wipe.

7. The dispenser of claim 1 wherein the outlet nozzle is elastomeric and comprises a silicon member.

8. The dispenser of claim 1 wherein the outlet nozzle comprises silicon.

9. A wipes dispenser comprising:

a container for holding a plurality of wipes;

the container having an opening at the top of the container;

a lid connectable to the top of the container to at least partially cover the opening;

the container having a sealed bottom;

a plurality of wipes contained within the container;

the plurality of wipes connected to one another in a roll having a cylindrical shape;

the roll having an opening in the center;

the plurality of wipes separated from one another by a perforated line;

a fluid for wetting the plurality of wipes;

the fluid retained at the bottom of the container; and a self-orientating outlet nozzle located in the lid and secured to the container;

the self-orientating nozzle having a housing that has a partial spherical shape;

a resilient member having an outlet opening secured to the housing; and a socket for receiving the housing;

wherein at least a portion of the housing can rotate within the socket; and wherein the self-orientating nozzle is configured to rotate toward any point around the circumference of the lid; and wherein the self-orientating outlet nozzle is configured to allow the wipe to be pulled out of the self-orientating outlet nozzle when the outlet nozzle is at an angle offset from a vertical angle.

10. The wipes dispenser of claim 9 further comprising a plurality of wipes.

11. The wipes dispenser of claim 9 further comprising a cap wherein the socket is formed at least in part by a portion of the cap.

12. The wipes dispenser of claim 9 wherein the socket has an opening at the top and an opening at the bottom.

13. The wipes dispenser of claim 9 further comprising a retaining member wherein the retaining member has a sloped surface.

14. The wipes dispenser of claim 9 wherein the resilient member is in the form of a dome and the outlet is round.

15. A wipes dispenser having self-orientating outlet nozzle comprising:

a container for holding a plurality of wipes and a liquid for wetting the wipes;

the container having an opening at the top of the container;

a lid connectable to the top of the container to at least partially cover the opening;

the container having a sealed bottom;

a plurality of wipes contained within the container;

the plurality of wipes connected to one another in a roll having a cylindrical shape;

the roll having an opening in the center;

the plurality of wipes separated from one another by a perforated line;

a fluid for wetting the plurality of wipes;

the fluid retained at the bottom of the container;

a self-orientating outlet nozzle located in the lid of the container;

the self-orientating outlet nozzle having an inlet opening that is located over the top of the opening in the center of the roll;

the self-orientating outlet nozzle having an outlet opening;

a connector for connecting the self-orientating outlet nozzle to the container;

wherein the connector is configured so that the outlet of the self-orientating outlet nozzle is moveable with respect to the container and moves so that the opening is aligned with a wipe pull direction when the wipe pull direction is offset from a vertical position;

wherein the self-orientating nozzle is configured to rotate toward any point around the circumference of the lid; and wherein the self-orientating outlet nozzle is configured to allow the wipe to be pulled out of the self-orientating outlet nozzle when the outlet nozzle is at an angle offset from a vertical angle.

16. The wipes dispenser of claim 15 wherein the self-orientating outlet nozzle comprises a ball and a socket.

17. The wipes dispenser of claim 15 wherein the self-orientating outlet nozzle comprises an elastomeric member.

18. The wipes dispenser of claim 15 wherein the self-orientating outlet nozzle comprises one or more hinges.

19. The wipes dispenser of claim 15 wherein the self-orientating outlet nozzle comprises a bellows.

20. The wipes dispenser of claim 15 wherein the self-orientating outlet nozzle comprises a swivel member.

* * * * *